US005713378A

United States Patent [19]

Smith

[11] Patent Number: 5,713,378

[45] Date of Patent: Feb. 3, 1998

[54] JET SPRAY FINGERNAIL CLEANER APPARATUS

[76] Inventor: Roy F. Smith, Box 458, Redwater, Alberta, Canada

[21] Appl. No.: 753,849

[22] Filed: Dec. 2, 1996

[51] Int. Cl.[6] ..... A45D 29/18

[52] U.S. Cl. ..... 132/74.5; 132/73; 132/75; 134/182

[58] Field of Search ..... 132/74.5, 73.6, 132/73, 75, 76.2, 75.8, 286; 128/366, 368; 401/195; 134/182, 183, 191, 198, 199, 200, 201; 4/621, 625, 650

[56] References Cited

U.S. PATENT DOCUMENTS

| | | | |
|---|---|---|---|
| 4,020,856 | 5/1977 | Masterson | 132/74.5 |
| 4,137,929 | 2/1979 | Grossman | 134/182 |
| 4,289,152 | 9/1981 | Führe | 132/74.5 |
| 4,742,836 | 5/1988 | Buehler | 132/74.5 |
| 5,640,979 | 6/1997 | Trenary | 132/73.6 |

*Primary Examiner*—Gene Mancene
*Assistant Examiner*—Pedro Philogene

[57] ABSTRACT

A jet spray fingernail cleaner apparatus including a pulsating pump. The pump has a fluid exhaust tube for releasing a fluid that is held within the pump. Included is a housing that has a bottom wall with an aperture and a cylindrical side wall. The side wall has a top edge for forming a top opening of the housing. The side wall has a pair of horizontal wedge-shaped arms along opposite portions of the side wall. Each arm has an arm tip extending past a rear portion of the arm. Included is an elongated resilient finger stall for positioning within the housing. The finger stall has an upper end and a rear end with a fluid intake line that extends therefrom and through the aperture of the bottom wall of the housing. The fluid intake line couples with the fluid exhaust tube of the pump for allowing a jet stream of fluid to flow into the finger stall. Lastly, an O-ring is positioned over the housing to secure the finger stall about the housing, when the upper end is folded around the housing.

8 Claims, 3 Drawing Sheets

JET SPRAY FINGERNAIL CLEANER APPARATUS

BACKGROUND OF THE INVENTION

1. Field of the Invention

The present invention relates to a jet spray fingernail cleaner apparatus and more particularly pertains to providing an apparatus, upon receipt of a finger, that will enclose the finger and employ pulsating water streams to clean the fingernail of the finger.

2. Description of the Prior Art

The use of a fingernail cleaning device is known in the prior art. More specifically, fingernail cleaning devices heretofore devised and utilized for the purpose of cleaning a fingernail are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,742,836 to Buehler discloses a fingernail cleaning device. U.S. Pat. No. 4,289,152 to Fuhre discloses a nail cleaner. U.S. Pat. No. 4,180,884 to Hess et al. discloses a fingernail cleaning apparatus. U.S. Pat. No. 4,137,929 to Gorssman discloses a fingernail cleaner. Lastly, U.S. Pat. No. 3,982,965 to Stotz discloses a water jet cleaning appliance.

While these devices fulfill their respective, particular objectives and requirements, the aforementioned patents do not describe jet spray fingernail cleaner apparatus that allows a finger stall to be supported in a housing unit, with the finger stall having a fluid intake line that couples with a fluid exhaust line of a pump, and in receipt of a jet stream flow of fluid to be sprayed into the finger stall and under the fingernail for cleaning the fingernail.

In this respect, the jet spray fingernail cleaner apparatus according to the present invention substantially departs from the conventional concepts and designs of the prior art, and in doing so provides an apparatus primarily developed for the purpose of providing an apparatus that upon receipt of a finger will enclose the finger and employ pulsating water streams to clean the fingernail of the finger.

Therefore, it can be appreciated that there exists a continuing need for a new and improved jet spray fingernail cleaner apparatus which can be used for providing an apparatus that upon receipt of a finger will enclose the finger and employ pulsating water streams to clean the fingernail of the finger. In this regard, the present invention substantially fulfills this need.

SUMMARY OF THE INVENTION

In view of the foregoing disadvantages inherent in the known types of fingernail cleaning devices now present in the prior art, the present invention provides an improved jet spray fingernail cleaner apparatus. As such, the general purpose of the present invention, which will be described subsequently in greater detail, is to provide a new and improved jet spray fingernail cleaner apparatus and method which has all the advantages of the prior art and none of the disadvantages.

To attain this, the present invention essentially comprises a pulsating pump that has a base portion for supporting a fluid container member. The pump has a fluid exhaust tube for releasing a fluid that is held within the fluid container member. Included is a generally cylindrical housing that has a bottom wall and a continuous cylindrical side wall. The side wall has a top edge forming a top opening of the housing. The bottom wall has an aperture. The side wall has a pair of horizontal wedge-shaped arms that extend outwardly from and along opposite portions of the side wall. Each arm has an arm tip that extends past a rear portion of the arm. The side wall has a pair of elongated slots symmetrically positioned between each arm along the side wall. The pair of elongated slots extend in substantially parallel relationship to a longitudinal axis of the housing to allow expanding and contracting of the housing when the pair of arms being pressed at the arm tips. Also, an elongated resilient finger stall is provided. The finger stall has an upper end and a rear end with a fluid intake line extending from the rear end. The finger stall has a waste fluid exit line integral therewith and projecting from a position spaced from the fluid intake line. The finger stall is positioned within the housing with the rear end adjacent the bottom wall of the housing and the upper end folded over the top edge of the housing. The fluid intake line is positioned through the aperture of the housing when the finger stall is positioned within the housing. The fluid intake line couples with the fluid exhaust tube of the pump to allow a jet stream of fluid to flow into the finger stall to clean under the fingernail of a finger positioned within the finger stall. Lastly, an O-ring is positioned over the housing and around the upper end of the finger stall when the upper end is folded over the top edge of the housing. The upper end of the finger stall is secured about the housing by the positioning of the O-ring around the housing.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved jet spray fingernail cleaner apparatus which has all of the advantages of the prior art fingernail cleaning devices and none of the disadvantages.

It is another object of the present invention to provide a new and improved jet spray fingernail cleaner apparatus which may be easily and efficiently manufactured and marketed.

It is further object of the present invention to provide a new and improved jet spray fingernail cleaner apparatus which is of durable and reliable constructions.

An even further object of the present invention is to provide a new and improved jet spray fingernail cleaner apparatus which is susceptible of a low cost of manufacture with regard to both materials and labor, and which accordingly is then susceptible of low prices of sale to the consuming public, thereby making such jet spray fingernail cleaner apparatus economically available to the buying public.

Even still another object of the present invention is to provide a jet spray fingernail cleaner apparatus for providing an apparatus that upon receipt of a finger will enclose the finger and employ pulsating water streams to clean the fingernail of the finger.

Lastly, it is an object of the present invention to provide a new and improved jet spray fingernail cleaner apparatus including a pulsating pump. The pump has a fluid exhaust tube for releasing a fluid that is held within the pump. Included is a housing that has a bottom wall with an aperture and a cylindrical side wall. The side wall has a top edge for forming a top opening of the housing. The side wall has a pair of horizontal wedge-shaped arms along opposite portions of the side wall. Each arm has an arm tip extending past a rear portion of the arm. Included is an elongated resilient finger stall for positioning within the housing. The finger stall has an upper end and a rear end with a fluid intake line that extends therefrom and through the aperture of the bottom wall of the housing. The fluid intake line couples with the fluid exhaust tube of the pump for allowing a jet stream of fluid to flow into the finger stall. Lastly, an O-ring is positioned over the housing to secure the finger stall about the housing, when the upper end is folded around the housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
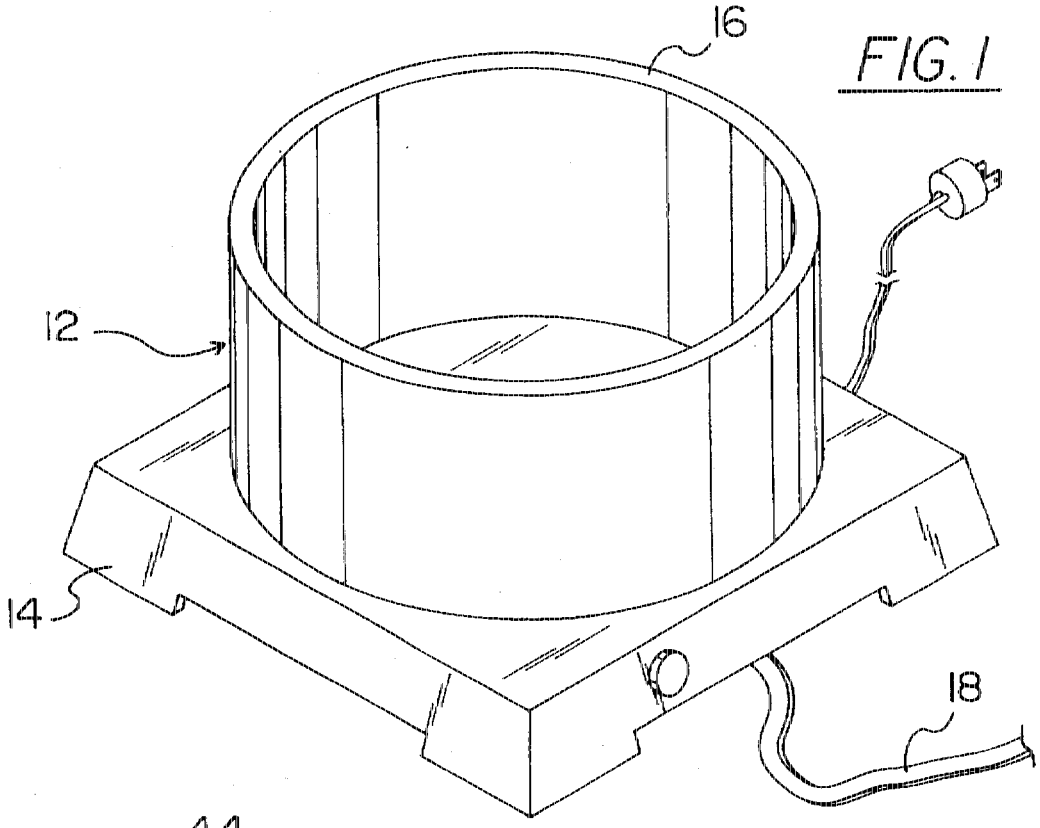
FIG. 1 is an isometric view of the pump of the present invention in accordance with the principles thereof.
Figure 2:
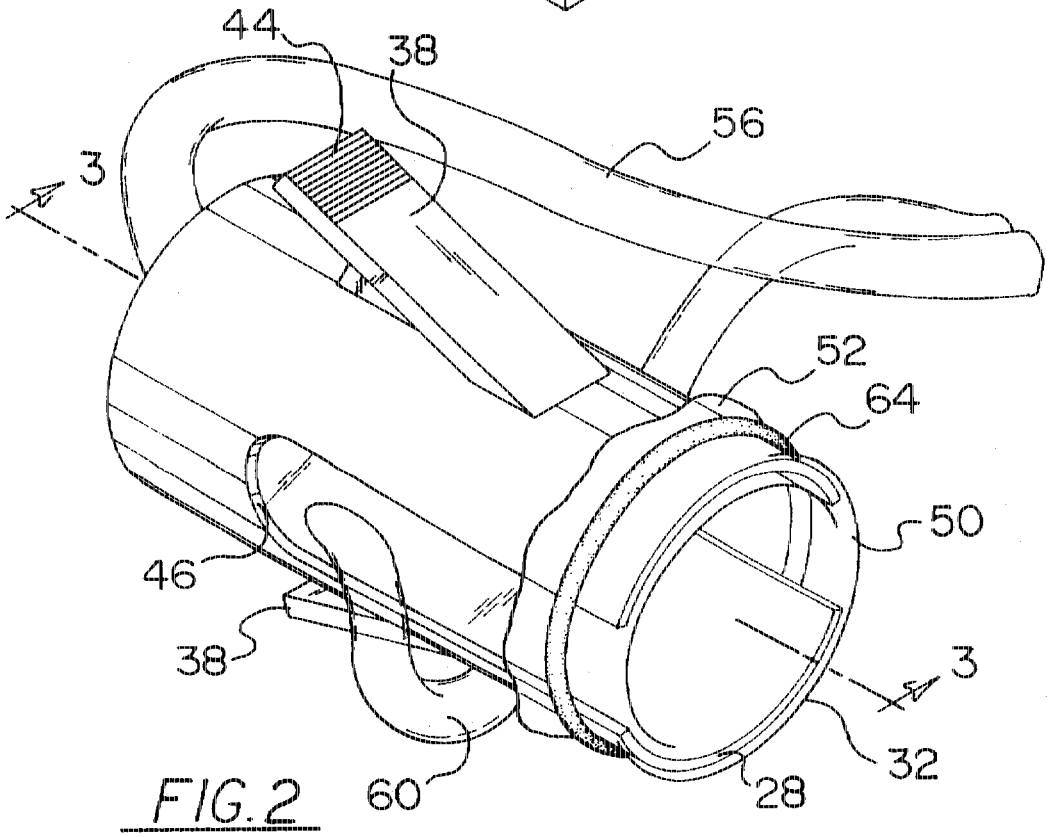
FIG. 2 is a perspective view of the preferred embodiment of the jet spray fingernail cleaner apparatus constructed in accordance with the principles of the present invention.

With reference now to the drawings, and in particular to FIGS. 1 and 2 thereof, the preferred embodiment of the new and improved jet spray fingernail cleaner apparatus embodying the principles and concepts of the present invention and generally designated by the reference numeral 10 will be described.

The present invention, the jet spray fingernail cleaner apparatus 10 is comprised of a plurality of components. Such components in their broadest context include a housing, a finger stall and an O-ring. Such components are individually configured and correlated with respect to each other so as to attain the desired objective.

Specifically, the present invention includes a pulsating pump 12. The pump has a base portion 14 for supporting a fluid container member 16. The fluid container member houses a fluid that is water or a water and soap solution. The pump has a fluid exhaust tube 18 for releasing the fluid that is held within the fluid container member. The fluid container member will hold about one liter of fluid. The pump, when turned on, will cause the fluid to move through the fluid exhaust tube under pressure.

Figure 3:
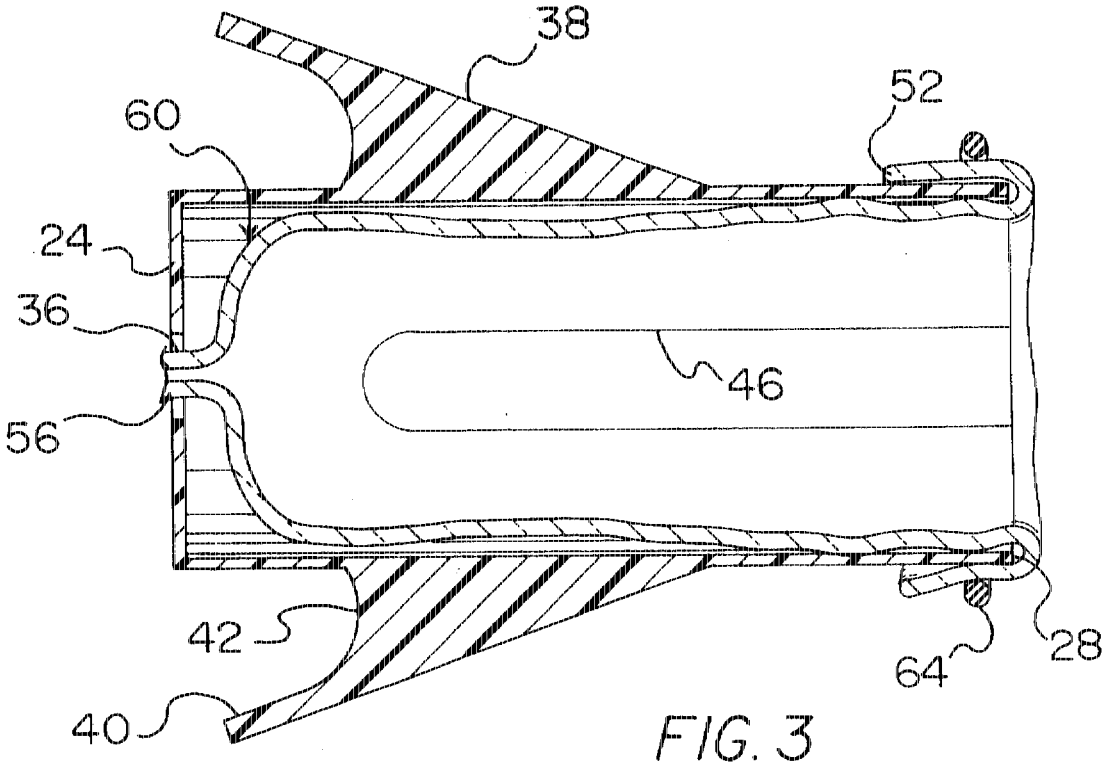
FIG. 3 is a cross-sectional view of the housing and finger stall of the present invention taken along line 3—3 of FIG. 2.
Figure 4:
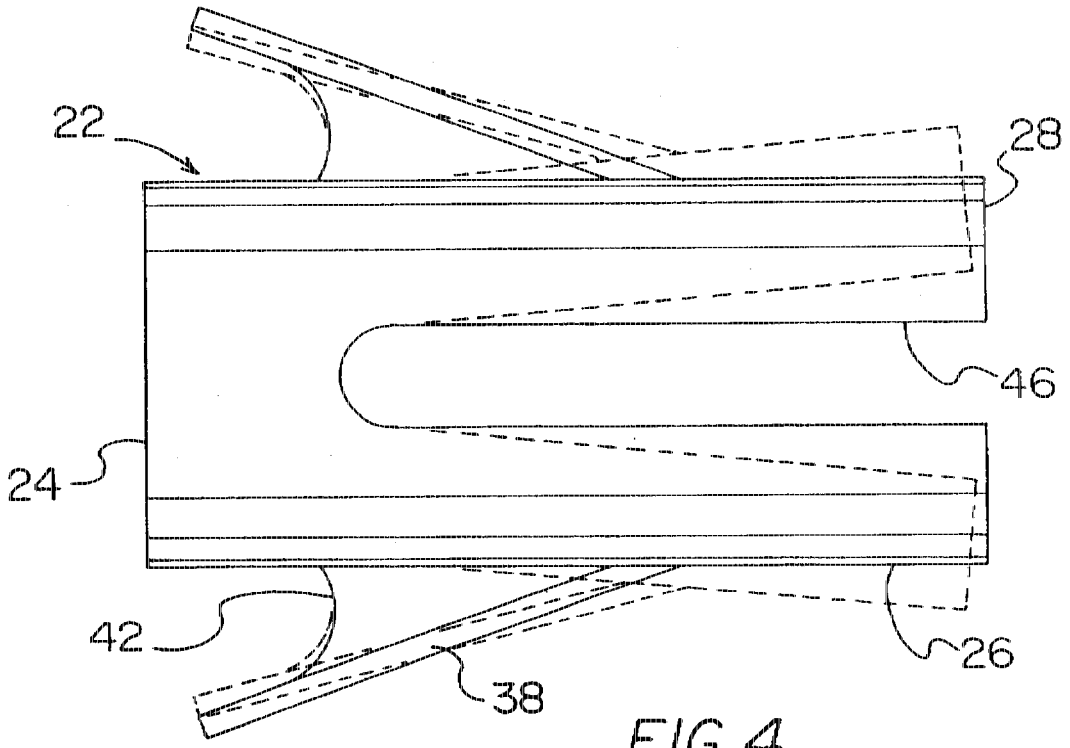
FIG. 4 is a side view of the housing of the present invention in an operable configuration.

As best illustrated in FIG. 4, a generally cylindrical housing 22 is included. The housing has a bottom wall 24 and a generally continuous cylindrical side wall 26. The side wall has a top edge 28 that forms a top opening 32 of the housing. The housing is formed of a resilient plastic. The bottom wall has an aperture 36 therethrough. The side wall has a pair of horizontal wedge-shaped arms 38 that extend outwardly from and along opposite portions of the side wall. As seen in FIG. 3, each arm has an arm tip 40 that extends past a rear portion 42 of the arm. The arm tip has a ribbed upper surface 44.

The side wall 26 of the housing 22 has a pair of elongated slots 46 that are symmetrically positioned between each arm 38 along the side wall. The pair of elongated slots extend in substantially parallel relationship to a longitudinal axis of the housing and partition the side walls of the housing. The pair of elongated slots allow the housing to expand and to contract when the pair of arms are pressed, toward the side wall, at the arm tips. The expanding and contracting of the housing is depicted in FIG. 4.

Figure 5:
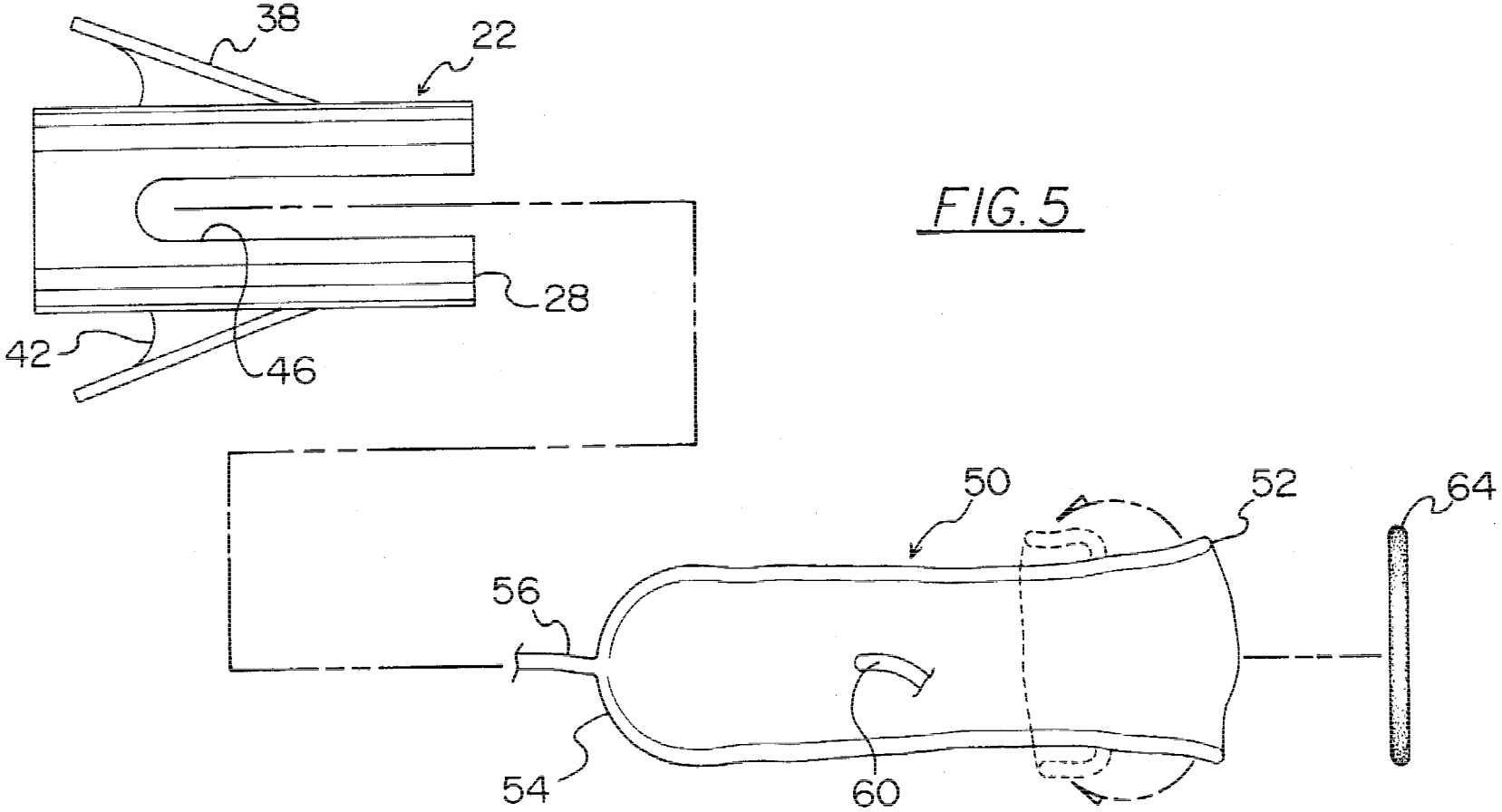
FIG. 5 is an exploded view of the operable components of the present invention.

Also, an elongated resilient finger stall 50 is provided. The finger stall is rubberized material that is similar to the material currently being used in gloves. The finger stall has an upper end 52 and a rear end 54 with a fluid intake line 56 that extends from the rear end. As shown in FIG. 5, the finger stall has a waste fluid exit line 60 that is integral therewith and projects from a position spaced from the fluid intake line. The waste fluid exit line is made from the same material used to make the finger stall. The finger stall is positioned within the housing with the rear end adjacent the bottom wall 24 of the housing 22, and the upper end folded over the top edge 28 of the housing. The fluid intake line is positioned through the aperture 36 of the housing when the finger stall is positioned within the housing. The fluid intake line will couple with the fluid exhaust tube of the pump once the finger stall is placed in the housing. The fluid intake line and the fluid exhaust tube are coupled to allow a jet stream of fluid to flow into the finger stall to clean under the fingernail of a finger positioned within the finger stall. The finger stall is positioned within the housing so that it may be comfortably placed around the finger and held there while water or a fluid flushes grim from underneath the fingernail.

Prior to placing the finger into the finger stall positioned in the housing, the finger stall must be secured in position. To secure the finger stall around the top edge of the housing, an O-ring 64 is provided. The O-ring is positioned over the housing 22 and around the upper end 52 of the finger stall, when the upper end is folded over the top edge of the housing, as seen in FIG. 3. The upper end of the finger stall is secured about the housing by the positioning of the O-ring. The housing, with the finger stall, fits firmly around the finger when the arms are pressed. When the arms are pressed, the finger and fluid can be easily released from within the finger stall.

The present invention is a jet spray fingernail cleaner device that employs pulsating water emitted from a pump to flow into the finger stall for cleaning the fingernail. The finger stall is made of a pliable synthetic rubber and is placed within the housing for strength and securing around the finger. The housing has a resilient capability which allows it to expand and contract around the finger once the finger has been placed therein. To expand the housing, one needs only to press against the arm tips of the arms, while releasing the arms tips automatically causes the housing to contract around the finger.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved jet spray fingernail cleaner apparatus for easy removal of material under a fingernail comprising in combination:

a pulsating pump having a base portion for supporting a fluid container member, the pump having a fluid exhaust tube coupled to the fluid container member for releasing a fluid being held within the fluid container member;

a generally cylindrical housing having a bottom wall and a continuous cylindrical side wall coupled thereto with a top edge forming a top opening of the housing, the bottom wall having an aperture there through, the side wall having a pair of horizontal wedge-shaped arms coupled to the side wall and extending outwardly from and along opposite portions of the side wall, each arm having an arm tip formed thereon and extending past a rear portion of the arm, the side wall having a pair of elongated slots symmetrically formed therein and positioned between each arm along the side wall, the pair of elongated slots extending in substantially parallel relationship to a longitudinal axis of the housing to allow expanding and contracting of the housing when the pair of arms being pressed at the arm tips;

an elongated resilient finger stall having an upper end and a rear end with a fluid intake line coupled thereto and extending therefrom, the finger stall having a waste fluid exit line integral therewith and projecting from a position spaced from the fluid intake line, the finger stall positioned within the housing with the rear end adjacent the bottom wall of the housing and the upper end folded over the top edge of the housing, the fluid intake line positioned through the aperture of the housing when the finger stall is positioned within the housing, the fluid intake line coupled with the fluid exhaust tube of the pump for allowing a jet stream of fluid to flow into the finger stall to clean under the fingernail of a finger positioned within the finger stall; and an O-ring being positioned about the side wall of the housing and around the upper end of the finger stall when the upper end being folded over the top edge of the housing, the upper end of the finger stall being secured about the housing by the positioning of the O-ring therearound.

2. A jet spray fingernail cleaner apparatus comprising:

a pulsating pump having a fluid exhaust tube coupled thereto for releasing a fluid being held within the pump;

a housing having a bottom wall with an aperture formed therein and a cylindrical side wall coupled thereto with a top edge forming a top opening of the housing, the side wall having a pair of horizontal wedge-shaped arms coupled along opposite portions of the side wall, each arm having an arm tip formed thereon and extending past a rear portion of the arm;

an elongated resilient finger stall positioned within the housing, the finger stall having an upper end and a rear end with a fluid intake line coupled thereto and extending therefrom and through the aperture of the bottom wall of the housing, the fluid intake line couples with the fluid exhaust tube of the pump for allowing a jet stream of fluid to flow into the finger stall; and an O-ring being positioned over the housing for securing the finger stall about the housing when the upper end is folded therearound.

3. The jet spray fingernail cleaner apparatus as set forth in claim 2, wherein the pump having a base portion for supporting a fluid container member.

4. The jet spray fingernail cleaner apparatus as set forth in claim 2, wherein the side wall of the housing being continuous and having a pair of elongated slots symmetrically positioned between each arm along the side wall.

5. The jet spray fingernail cleaner apparatus as set forth in claim 4, wherein the pair of elongated slots extending in substantially parallel relationship to a longitudinal axis of the housing to allow expanding and contracting of the housing when the pair of arms being pressed at the arm tips.

6. The jet spray fingernail cleaner apparatus as set forth in claim 2, wherein the finger stall having a waste fluid exit line integral therewith and projecting from a position spaced from the fluid intake line.

7. The jet spray fingernail cleaner apparatus as set forth in claim 2, wherein when the finger stall being positioned within the housing with the rear end adjacent the bottom wall of the housing and the upper end being folded over the top edge of the housing.

8. The jet spray fingernail cleaner apparatus as set forth in claim 2, the O-ring being positioned over the housing and around the upper end of the finger stall when the upper end being folded over the top edge of the housing.

* * * * *